US008755730B2

(12) United States Patent
Amita et al.

(10) Patent No.: US 8,755,730 B2
(45) Date of Patent: Jun. 17, 2014

(54) GLOSSING DEVICE AND IMAGE FORMING APPARATUS INCORPORATING SAME

(75) Inventors: Akiyasu Amita, Kanagawa (JP); Hiroyuki Kunii, Kanagawa (JP); Satoshi Muramatsu, Kanagawa (JP); Kunihiko Tomita, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 157 days.

(21) Appl. No.: 13/528,015

(22) Filed: Jun. 20, 2012

(65) Prior Publication Data

US 2012/0328346 A1 Dec. 27, 2012

(30) Foreign Application Priority Data

Jun. 22, 2011 (JP) ..... 2011-138985

(51) Int. Cl.
*G03G 15/20* (2006.01)

(52) U.S. Cl.
USPC ..... 399/341; 399/67; 399/122; 399/329; 399/342

(58) Field of Classification Search
USPC ..... 399/67, 91, 92, 94, 122, 320, 329, 341, 399/342
See application file for complete search history.

(56) References Cited

U.S. PATENT DOCUMENTS

| | | | |
|---|---|---|---|
| 5,527,657 | A | 6/1996 | Takeda et al. |
| 5,638,159 | A | 6/1997 | Kai et al. |
| 5,797,074 | A | 8/1998 | Kasahara et al. |
| 5,815,784 | A | 9/1998 | Kasahara et al. |
| 5,953,567 | A | 9/1999 | Muramatsu et al. |
| 5,960,246 | A | 9/1999 | Kasahara et al. |
| 5,987,298 | A | 11/1999 | Muramatsu et al. |
| 6,112,046 | A | 8/2000 | Suzuki et al. |
| 6,201,941 | B1 | 3/2001 | Kasahara et al. |
| 6,370,350 | B2 | 4/2002 | Tomita |
| 6,370,352 | B1 | 4/2002 | Tomita |
| 6,393,241 | B1 | 5/2002 | Matsumoto et al. |
| 6,413,690 | B2 | 7/2002 | Tomita |
| 6,455,217 | B2 | 9/2002 | Tomita |
| 6,492,084 | B2 | 12/2002 | Tomita |
| 6,505,016 | B2 | 1/2003 | Tomita |
| 6,507,720 | B2 | 1/2003 | Kabumoto et al. |

(Continued)

FOREIGN PATENT DOCUMENTS

| | | |
|---|---|---|
| JP | 5-333643 | 12/1993 |
| JP | 2004-85634 | 3/2004 |

(Continued)

*Primary Examiner* — David Gray
*Assistant Examiner* — Francis Gray
(74) *Attorney, Agent, or Firm* — Oblon, Spivak, McClelland, Maier & Neustadt, L.L.P.

(57) ABSTRACT

A glossing device includes a heater member, a stripper member, an endless rotary belt, a pressure member, and a belt cooler. The heater member is subjected to heating. The stripper member is disposed parallel to the heater member. The endless rotary belt is looped for rotation around the heater member and the stripper member in a longitudinal, conveyance direction of the belt. The pressure member is disposed opposite the heater member via the belt. The heater member and the pressure member press against each other via the belt to form a glossing nip therebetween. The recording medium after passage through the nip remains in contact with the belt as the belt moves from the heater member toward the stripper member, and separates from the belt as the belt passes around the stripper member. The belt cooler is disposed adjacent to the belt to cool the belt.

15 Claims, 7 Drawing Sheets

(56) References Cited

U.S. PATENT DOCUMENTS 6,519,439 B2 2/2003 Tomita
6,526,246 B2 2/2003 Iwata et al.
6,542,707 B2 4/2003 Muramatsu et al.
6,567,637 B2 5/2003 Yanagisawa et al.
6,571,076 B2 5/2003 Kasahara et al.
6,597,883 B2 7/2003 Muramatsu et al.
6,608,983 B2 8/2003 Terazawa et al.
6,623,897 B2 9/2003 Tomita
6,628,908 B2 9/2003 Matsumoto et al.
6,628,913 B2 9/2003 Matsumoto et al.
6,628,915 B2 9/2003 Muramatsu et al.
6,653,039 B2 11/2003 Tomita
6,678,492 B1 1/2004 Terazawa et al.
6,748,190 B2 6/2004 Yanagisawa et al.
6,778,788 B2 8/2004 Tomita et al.
6,785,496 B2 8/2004 Iwata et al.
6,813,464 B2 11/2004 Amita et al.
6,819,892 B2 11/2004 Nakazato et al.
6,826,381 B2 11/2004 Muramatsu et al.
6,871,034 B2 3/2005 Muramatsu et al.
6,882,812 B2 4/2005 Kasahara et al.
6,898,405 B2 5/2005 Matsumoto et al.
6,924,074 B2 8/2005 Tomita
6,939,614 B2 9/2005 Tomita
6,957,036 B2 10/2005 Kikuchi et al.
6,983,117 B2 1/2006 Sohmiya et al.
7,003,251 B2 2/2006 Suzuki et al.
7,010,257 B2 3/2006 Someya et al.
7,031,648 B2 4/2006 Takashi et al.
7,039,346 B2 5/2006 Terazawa et al.
7,043,179 B2 5/2006 Matsumoto et al.
7,046,949 B2 5/2006 Tomita et al.
7,054,570 B2 5/2006 Kishi et al.
7,065,313 B2 6/2006 Matsumoto et al.
7,076,191 B2 7/2006 Muramatsu et al.
7,085,522 B2 8/2006 Muramatsu et al.
7,088,945 B2 8/2006 Matsumoto et al.
7,103,305 B2 9/2006 Koike et al.
7,116,923 B2 10/2006 Kishi et al.
7,116,928 B2 10/2006 Muramatsu et al.
7,127,198 B2 10/2006 Muramatsu et al.
7,127,202 B2 10/2006 Fujita et al.
7,130,555 B2 10/2006 Kishi et al.
7,130,558 B2 10/2006 Matsumoto et al.
7,139,520 B2 11/2006 Echigo et al.
7,177,580 B2 2/2007 Nakafuji et al.
7,197,269 B2 3/2007 Omata et al.
7,209,675 B2 4/2007 Matsusaka et al.
7,209,689 B2 4/2007 Matsumoto et al.
7,212,758 B2 5/2007 Kishi et al.
7,212,759 B2 5/2007 Kishi et al.
7,218,880 B2 5/2007 Yanagisawa et al.
7,221,891 B2 5/2007 Matsumoto et al.
7,233,762 B2 6/2007 Kunii et al.
7,239,821 B2 7/2007 Matsusaka et al.
7,245,853 B2 7/2007 Muramatsu et al.
7,254,360 B2 8/2007 Tomita
7,254,362 B2 8/2007 Kikuchi et al.
7,257,348 B2 8/2007 Matsumoto et al.
7,269,384 B2 9/2007 Someya et al.
7,277,664 B2 10/2007 Katsuyama et al.
7,277,665 B2 10/2007 Terazawa et al.
7,289,748 B2 10/2007 Yanagisawa et al.
7,295,795 B2 11/2007 Suzuki et al.
7,299,003 B2 11/2007 Kurotaka et al.
7,308,216 B2 12/2007 Kishi et al.
7,309,553 B2 12/2007 Tomita et al.
7,313,336 B2 12/2007 Kadota et al.
7,333,743 B2 2/2008 Kishi et al.
7,333,760 B2 2/2008 Baba et al.
7,343,113 B2 3/2008 Matsusaka et al.
7,346,286 B2 3/2008 Matsumoto et al.
7,346,299 B2 3/2008 Muramatsu et al.
7,352,987 B2 4/2008 Iwata et al.
7,356,270 B2 4/2008 Matsusaka et al.
7,356,288 B2 4/2008 Iwata et al.
7,356,290 B2 4/2008 Matsumoto et al.
7,356,298 B2 4/2008 Tomita et al.
7,359,666 B2 4/2008 Takashi et al.
7,366,432 B2 4/2008 Kishi et al.
7,369,803 B2 5/2008 Echigo et al.
7,373,094 B2 5/2008 Kishi et al.
7,406,278 B2 7/2008 Katsuyama et al.
7,433,641 B2 10/2008 Kikuchi et al.
7,444,107 B2 10/2008 Takeuchi et al.
7,450,891 B2 11/2008 Muramatsu et al.
7,480,473 B2 1/2009 Matsuura et al.
7,496,309 B2 2/2009 Matsusaka et al.
7,509,079 B2 3/2009 Muramatsu et al.
7,512,364 B2 3/2009 Muramatsu et al.
7,515,845 B2 4/2009 Kishi et al.
7,526,242 B2 4/2009 Takagaki et al.
7,536,139 B2 5/2009 Katsuyama et al.
7,542,697 B2 6/2009 Matsumoto et al.
7,542,703 B2 6/2009 Kasahara et al.
7,551,869 B2 6/2009 Kishi et al.
7,565,087 B2 7/2009 Matsusaka et al.
7,570,911 B2 8/2009 Nakafuji et al.
7,583,922 B2 9/2009 Takashi et al.
7,590,376 B2 9/2009 Tomita et al.
7,593,674 B2 9/2009 Matsumoto et al.
7,603,049 B2 10/2009 Kishi et al.
7,603,054 B2 10/2009 Katsuyama et al.
7,609,988 B2 10/2009 Kishi et al.
7,664,410 B2 2/2010 Takagi
7,738,827 B2 6/2010 Someya et al.
7,778,577 B2 8/2010 Muramatsu et al.
7,796,914 B2 9/2010 Matsumoto et al.
7,809,322 B2 10/2010 Takeuchi et al.
7,885,569 B2 2/2011 Kishi et al.
7,894,753 B2 2/2011 Kasahara et al.
7,904,006 B2 3/2011 Muramatsu
7,912,392 B2 3/2011 Yoshinaga et al.
7,917,055 B2 3/2011 Katsuyama et al.
7,925,177 B2 4/2011 Ishii et al.
7,957,663 B2 6/2011 Kishi et al.
8,073,352 B2 12/2011 Kunii et al.
8,131,198 B2 3/2012 Ishii et al.
8,180,261 B2 5/2012 Muramatsu et al.
2003/0207194 A1 11/2003 Tomita
2005/0158075 A1 7/2005 Echigo et al.
2006/0013624 A1 1/2006 Kurotaka et al.
2006/0051111 A1 3/2006 Kishi et al.
2007/0031159 A1 2/2007 Kishi et al.
2009/0103959 A1* 4/2009 Koyama et al. ..... 399/341
2009/0154967 A1 6/2009 Tomita
2010/0008706 A1 1/2010 Sugiura et al.
2010/0183323 A1* 7/2010 Fujiya et al. ..... 399/44
2010/0232818 A1 9/2010 Kunii
2010/0239337 A1 9/2010 Muramatsu et al.
2010/0310289 A1 12/2010 Someya et al.
2011/0052249 A1* 3/2011 Iijima et al. ..... 399/94
2011/0064493 A1 3/2011 Muramatsu et al.
2011/0064494 A1 3/2011 Amita et al.
2011/0170895 A1* 7/2011 Fujiya et al. ..... 399/94
2011/0176822 A1 7/2011 Ishii et al.
2011/0188911 A1 8/2011 Kunii et al.
2012/0008153 A1 1/2012 Kunii et al.
2012/0201579 A1* 8/2012 Kunii et al. ..... 399/328
2012/0224898 A1* 9/2012 Amita et al. ..... 399/341
2012/0315069 A1* 12/2012 Ikeda et al. ..... 399/341
2012/0328344 A1* 12/2012 Kunii et al. ..... 399/341

FOREIGN PATENT DOCUMENTS

JP 2004-325934 11/2004
JP 2008-170539 7/2008
JP 2009-14876 1/2009

* cited by examiner

GLOSSING DEVICE AND IMAGE FORMING APPARATUS INCORPORATING SAME

CROSS-REFERENCE TO RELATED APPLICATION

This patent application claims priority pursuant to 35 U.S.C. §119 to Japanese Patent Application No. 2011-138985, filed on Jun. 22, 2011, the entire disclosure of which is hereby incorporated by reference herein.

BACKGROUND OF THE INVENTION

1. Technical Field

The present invention relates to a glossing device and an image forming apparatus incorporating the same, and more particularly, to a glossing device that processes a toner image with heat and pressure on a recording medium, and an electrophotographic image forming apparatus, such as a photocopier, facsimile machine, printer, plotter, or multifunctional machine incorporating several of these features, which incorporates such a glossing capability.

2. Background Art

In electrophotographic image forming apparatuses, such as photocopiers, facsimile machines, printers, plotters, or multifunctional machines incorporating several of those imaging functions, an image is formed by attracting toner particles to a photoconductive surface for subsequent transfer to a recording medium such as a sheet of paper. After transfer, the imaging process may be followed by a fixing process using a fixing device, which permanently fixes the toner image in place on the recording medium by melting and setting the toner with heat and pressure.

Various techniques have been proposed to provide printing with high-gloss, photo-like imaging quality, several of which are directed to development of a more sophisticated fixing process.

Structurally, a fixing device with a glossing capability may be constructed of an endless rotary belt on which a recording medium is conveyed while subjected to heat and pressure. The endless belt is looped for rotation around multiple parallel rollers, including a heated roller and a stripper roller, with a pressure roller disposed opposite the heated roller via the belt to form a fixing nip therebetween.

During operation, a recording medium bearing a toner image, either unfixed or pre-fixed, thereon is conveyed through the fixing nip, which renders the incoming toner image into a semi-fluid, soft pliable adhesive state under heat and pressure. After passage through the fixing nip, the recording medium is conveyed with the toner image adhering to the belt, which imparts gloss to the toner image as the molten toner gradually cools and solidifies while conforming to the smooth surface of the belt. The recording medium closely contacts the belt as the belt moves from the heated roller toward the stripper roller, and separates from the belt as the belt passes around the separator roller.

To date, belt-based fixing devices are designed with a belt cooler for cooling an endless rotary belt during conveyance of a recording medium downstream from a fixing nip, so as to provide efficient, uniform cooling of the recording medium to a desired temperature after fixing and glossing a toner image thereon.

For example, one known technique proposes a dual-mode glossing device for processing a toner image in a high-gloss mode or a low-gloss mode using an endless belt, which employs a pair of cooling devices, one disposed inside and the other outside the loop of the endless belt, to cool the belt and the recording medium in contact with the belt. The paired cooling devices may be electric fans that remove heat by directing an air flow to the belt, or those that employ a thermally conductive member, such as a heat pipe or heat sink, containing water or liquid coolant flowing therethrough to absorb heat from the belt through contact with the thermally conductive member.

Another known technique proposes a fixing system including a thermal pre-fixing unit and a gloss adjustment unit for adjusting glossiness of the toner image using an endless belt, which employs a cooling device disposed inside the loop of the endless belt to cool a toner image on the recording medium being conveyed. The cooling device includes a heat dissipator or heat sink disposed in contact with the belt to absorb heat from the belt. The heat dissipator may be used in combination with a cooling fan disposed outside the loop of the belt, which assists in cooling the belt by directing an air flow to the belt.

Still another known technique proposes a copying system including a gloss detector for measuring glossiness of an original document, and a belt-based fixing device for adjusting gloss of a copied image according to the measured gloss of the original, which employs a cooling device disposed outside the loop of the endless belt to cool the belt to a variable, adjustable temperature. The cooling device includes a cooling fan that operates at an adjustable flow rate to control the temperature of the belt according to readings of the gloss detection unit, so as to provide the resulting print with a high-gloss or low-gloss appearance similar to that of the original document.

Yet still another known technique proposes a belt-based fixing device that can control an amount of compression experienced by the belt upon cooling, which employs a cooling device disposed inside the loop of the endless belt to cool the belt to a desired temperature. The cooling device includes multiple cooling members of different cooling capacities disposed in thermal contact with the belt, which are arranged with respect to each other in a longitudinal, conveyance direction of the belt such that those located upstream have lower heat capacities than those located downstream for preventing the belt from a rapid temperature change and a concomitant thermal contraction during cooling.

Although generally successful for their intended purposes, the approaches depicted above have several drawbacks.

For example, the belt cooler employed in those belt-based fixing devices is vulnerable to reduced efficiency where a large number of print jobs are sequentially processed. Sequential processing of print jobs often results in substantial amounts of heat released to the surrounding over time. In case of air-cooled, non-contact cooling that employs a cooling fan, heat released to the surrounding air translates into a heated air flow generated by the cooling fan, and a concomitant rise in temperature of the belt. In case of a contact cooling system or heat sink that directly contacts an endless rotary belt to absorb heat from the belt, heat released during sequential processing of print jobs gradually heats the heat sink, which then no longer works to remove heat from the belt as efficiently as intended.

Failure to properly cool the belt to a desired temperature results in failure to provide printing with high-gloss, photo-like imaging quality. The problem is particularly pronounced in high-speed printing applications where the endless belt rotates at a relatively high processing speed, which translates into a reduced duration of time during which the belt is subjected to cooling within a single operational cycle.

SUMMARY OF THE INVENTION

Exemplary aspects of the present invention are put forward in view of the above-described circumstances, and provide a novel glossing device for processing a toner image on a recording medium.

In one exemplary embodiment, the glossing device includes a heater member, a stripper member, an endless rotary belt, a pressure member, and a belt cooler. The heater member is subjected to heating. The stripper member is disposed parallel to the heater member. The endless rotary belt is looped for rotation around the heater member and the stripper member in a longitudinal, conveyance direction of the belt. The pressure member is disposed opposite the heater member via the belt. The heater member and the pressure member press against each other via the belt to form a glossing nip therebetween through which the recording medium is conveyed under heat and pressure. The recording medium after passage through the nip remains in contact with the belt as the belt moves from the heater member toward the stripper member, and separates from the belt as the belt passes around the stripper member. The belt cooler is disposed adjacent to the belt to cool the belt downstream from the heater member and upstream from the stripper member. The belt cooler includes a pair of separate, first and second cooling elements and a pair of firs and second heat dissipators. The pair of first and second cooling elements is disposed inside the loop of the belt, the former being closer than the latter to the heater member in the conveyance direction of the belt, to establish thermal contact with the belt. The pair of first and second heat dissipators is connected to the first and second cooling elements, respectively, to dissipate heat from the cooling element. The first heat dissipator exhibits a cooling capacity higher than that of the second heat dissipator.

Other exemplary aspects of the present invention are put forward in view of the above-described circumstances, and provide an image forming apparatus incorporating a glossing device.

BRIEF DESCRIPTION OF THE SEVERAL VIEWS OF THE DRAWINGS

A more complete appreciation of the disclosure and many of the attendant advantages thereof will be more readily obtained as the same becomes better understood by reference to the following detailed description when considered in connection with the accompanying drawings, wherein.

DETAILED DESCRIPTION OF THE INVENTION

Figure 1:
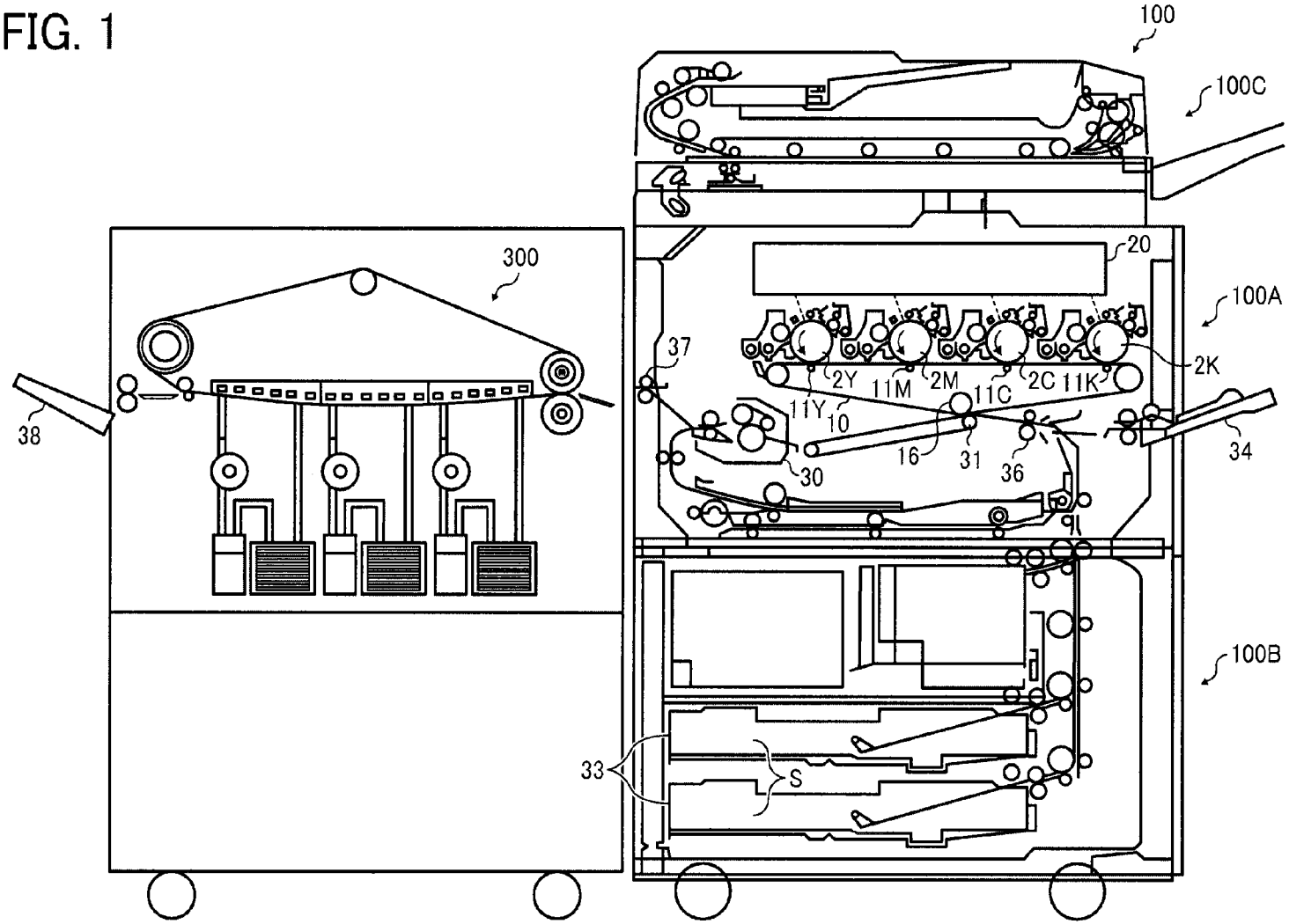
FIG. 1 schematically illustrates an image forming apparatus according to one embodiment of this patent specification.

In describing exemplary embodiments illustrated in the drawings, specific terminology is employed for the sake of clarity. However, the disclosure of this patent specification is not intended to be limited to the specific terminology so selected, and it is to be understood that each specific element includes all technical equivalents that operate in a similar manner and achieve a similar result.

Referring now to the drawings, wherein like reference numerals designate identical or corresponding parts throughout the several views, exemplary embodiments of the present patent application are described.

FIG. 1 schematically illustrates an image forming apparatus 100 according to one embodiment of this patent specification.

As shown in FIG. 1, the image forming apparatus 100 is a digital color imaging system that can print a color image on a recording medium such as a sheet of paper S according to image data, consisting of a generally upper, printer section 100A, and a generally lower, sheet feeding section 100B combined together to form a freestanding unit, on top of which may be deployed an appropriate image scanner 100C, that allows for capturing image data from an original document.

The printer section 100A comprises a tandem color printer that forms a color image by combining images of yellow, magenta, and cyan (i.e., the complements of three subtractive primary colors) as well as black, consisting of four electrophotographic imaging stations 1Y, 1M, 1C, and 1K arranged in series substantially laterally along the length of an intermediate transfer belt 10, each forming an image with toner particles of a particular primary color, as designated by the suffixes "Y" for yellow, "M" for magenta, "C" for cyan, and "K" for black.

Each imaging station 1 includes a drum-shaped photoconductor 2 rotatable counterclockwise in the drawing, having its outer, photoconductive surface exposed to an exposure device 20 while surrounded by various pieces of imaging equipment, such as a charging device, a development device accommodating toner of the associated primary color, a primary transfer device incorporating an electrically biased, primary transfer roller 11, and a cleaning device for the photoconductive surface, which work in cooperation to form a primary toner image on the photoconductor 2 for subsequent transfer to the intermediate transfer belt 10 at a primary transfer nip defined between the photoconductive drum 2 and the primary transfer roller 11.

The intermediate transfer belt 10 is trained around multiple support rollers to rotate clockwise in the drawing, passing through the four primary transfer nips sequentially to carry thereon a multi-color toner image toward a secondary transfer nip defined between a secondary transfer roller 31 and a backup roller 16, at which the toner image is transferred to a recording sheet S fed from the sheet feeding section 100B.

The sheet feeding section 100B includes one or more sheet trays 33 each accommodating a stack of recording sheets S, as well as a sheet conveyance mechanism, including multiple rollers and guide plates, which together define a sheet conveyance path for conveying a recording sheet S from the sheet tray 33 or a manual input sheet tray 34, between a pair of registration rollers 36, then through the secondary transfer nip, and then through a fixing device 30 which fixes the toner image in place on the recording sheet S with heat and pressure.

Figure 2:
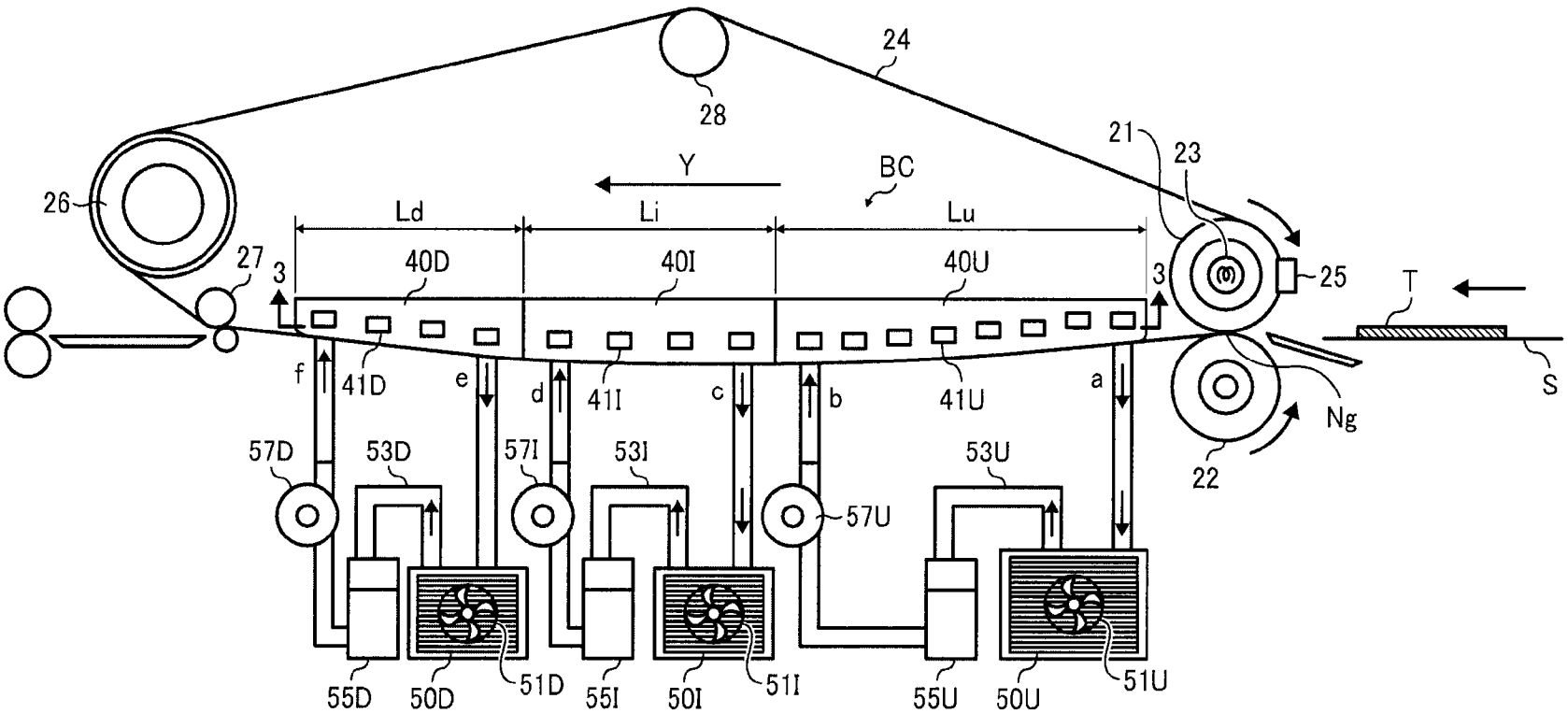
FIG. 2 is an end-on, axial view of a glossing device according to one or more embodiments of this patent specification.

The image forming apparatus 100 is provided with a glossing device 300 which is in the present embodiment configured as an external, standalone unit having an input unit connected to an output unit 37 of the printer section 100A to receive the recording sheet S downstream from the fixing device 30, and an output unit for ejecting the recording sheet S to an output tray 38 for use pickup A detailed description of the glossing device 300 and its associated structure will be given with reference to FIG. 2 and subsequent drawings.

During operation, each imaging station 1 rotates the photoconductor drum 2 clockwise in the drawing to forward its photoconductive surface to a series of electrophotographic processes, including charging, exposure, development, transfer, and cleaning, in one rotation of the photoconductor drum 2.

First, the photoconductive surface is uniformly charged to a specific polarity by the charging device and subsequently exposed to a modulated laser beam emitted from the exposure device 20. The laser exposure selectively dissipates the charge on the photoconductive surface to form an electrostatic latent image thereon according to image data representing a particular primary color. Then, the latent image enters the development device which renders the incoming image visible using toner. The toner image thus obtained is forwarded to the primary transfer device that electrostatically transfers the primary toner image to the intermediate transfer belt 10 through the primary transfer nip.

Such imaging operation may be performed without employing all the four imaging stations 1Y, 1M, 1C, and 1K. For example, a monochrome image of a particular primary color is formed with only a single imaging station 1 dedicated to the specific primary color, whereas a bi-color or tri-color image is formed with selected two or three imaging stations. In particular, a black-and-white image may be formed with only the black imaging station 1K instead of activating all the four imaging stations.

As the multiple imaging stations 1 sequentially produce toner images of different colors at the four transfer nips along the belt travel path, the primary toner images are superimposed one atop another to form a single multicolor image on the moving surface of the intermediate transfer belt 10 for subsequent entry to the secondary transfer nip between the secondary transfer roller 31 and the backup roller 16.

Meanwhile, the sheet conveyance mechanism picks up a recording sheet S from atop the sheet stack in the sheet tray 33 or the manual input tray 34 to introduce it between the pair of registration rollers 36 being rotated. Upon receiving the incoming sheet S, the registration rollers 36 stop rotation to hold the sheet S therebetween, and then advance it in sync with the movement of the intermediate transfer belt 10 to the secondary transfer nip.

At the secondary transfer nip, the multicolor image is transferred from the belt 10 to the recording sheet S, which is then introduced into the fixing device 30 to fix the toner image in place under heat and pressure. After fixing, the recording sheet S may be output to the glossing device 300 where printing with a high-gloss, photo-like appearance is required, which processes the toner image with heat and pressure to impart gloss to the resulting print. The recording sheet S after fixing and subsequent glossing is output to the output tray 38, which completes one operational cycle of the image forming apparatus 100.

FIG. 2 is an end-on, axial view of the glossing device 300 according to one or more embodiments of this patent specification.

As shown in FIG. 2, the glossing device 300 includes a heater roller 21 subjected to heating; a stripper roller 27 disposed parallel to the heater roller 21; an endless rotary glossing belt 24 looped for rotation around the heater roller 21 and the stripper roller 27 in a longitudinal, conveyance direction Y of the belt 24; a pressure roller 22 disposed opposite the heater roller 21 via the glossing belt 24; and a belt cooler BC disposed adjacent to the glossing belt 24 to cool the belt 24 downstream from the heater roller 21 and upstream from the stripper roller 27.

The heater roller 21 and the pressure roller 22 press against each other via the glossing belt 24 to form a glossing nip Ng therebetween through which a recording sheet S is conveyed to process a toner image T under heat and pressure. The recording sheet S after passage through the glossing nip Ng remains in contact with the glossing belt 24 as the belt 24 moves from the heater roller 21 toward the second roller 27, and separates from the glossing belt 24 as the glossing belt 24 passes around the second roller 27.

As used herein, the terms "upstream" and "downstream" refer to relative positions of components surrounding the glossing belt 24 in the longitudinal, conveyance direction Y in which the glossing belt 24 moves from the heater roller 21 toward the stripper roller 27 during operation of the glossing device 300. In particular, these terms are used to describe the position of the belt cooler BC with respect to the parallel rollers 21 and 27, in which the belt cooler BC extends upstream from the heater roller 21 and downstream from the pressure roller 22 in the conveyance direction Y of the belt 24.

Also included in the glossing device 300 are a motor-driven roller 26 downstream from the separator roller 27 for imparting a torque or rotational force to the belt 24, and a tension roller 28 upstream from the heater roller 21 for imparting tension to the belt 24. A heat source 23, such as a halogen heater, is provided in the heater roller 21 to internally heat the roller 21 to in turn heat the glossing belt 24. A temperature sensor or thermistor 25 is disposed adjacent to the heater roller 21 outside the loop of the glossing belt 24 and on the side of the heater roller 21 away from the pressure roller 22 to measure temperature at an outer surface of the glossing belt 24. A controller, such as a central processing unit (CPU) with associated memory devices, may be provided to control operation of the heater 23, for example, through on-off control according to readings of the thermistor 25 to maintain the belt temperature at a desired operational temperature.

Specifically, in the present embodiment, the heater roller 21 comprises a hollow cylindrical body of metal, such as aluminum or the like, approximately 50 mm to approximately 120 mm in diameter.

The heat source 23 comprises any suitable heating element that generates an amount of heat sufficient to re-melt and re-fuse toner accommodated in the fixing device 300. For example, the heat source 23 may be a halogen heater accommodated in the hollow interior of the heater roller 21 to radiate heat to an inner surface of the heater roller 21, from which heat is imparted to the glossing belt 24 entrained around the heated roller 21. Operation of the heater is computer-controlled according to readings of the thermistor 25 so as to maintain the belt surface at a desired operational temperature, such as, for example, in a range of from approximately 100° C. to approximately 180° C.

The endless glossing belt 24 comprises a bi-layered flexible belt consisting of an inner substrate and an outer surface layer deposited on the substrate, looped into a generally cylindrical configuration for rotation at a circumferential velocity of, for example, from approximately 50 mm/sec to approximately 700 mm/sec when driven as the motor-driven roller 26 rotates.

The substrate of the belt 24 may be formed of a sheet of heat-resistant resin or polymer, such as, for example, polyester, polyethylene, polyethylene terephthalate, polyethersulfone, polyetherketone, polysulfone, polyimide, polyamide-imide, polyamide, or the like, approximately 10 μm to approximately 300 μm in thickness. The surface layer of the belt 24 may be formed of a deposit of elastic material, such as silicone resin, fluorine resin, or the like, approximately 1 μm to approximately 100 μm in thickness, which forms a sufficiently smooth surface for obtaining high glossing performance, with its arithmetic average roughness not exceeding 0.3 μm, preferably, not exceeding 0.1 μm.

The pressure roller 22 comprises a cylindrical body approximately 50 mm to approximately 120 mm in diameter, consisting of a cylindrical core of metal, covered with an outer layer of elastic material, such as fluorine rubber, silicone rubber, or the like, approximately 5 mm to approximately 30 mm thick, deposited on the cylindrical core, as well as a coating of fluorine rubber, approximately 30 μm to approximately 200 μm thick, formed into a tubular configuration wrapping around the cylindrical roller body.

The pressure roller 22 is equipped with a suitable biasing mechanism which allows the pressure roller 22 to move relative to the glossing belt 24 and the heater roller 21, so as to adjust a width of the glossing nip Ng to approximately 10 mm to approximately 40 mm in the conveyance direction Y of the glossing belt 24.

During operation, upon entry into the glossing device 300, a recording sheet S bearing a toner image T printed and fixed thereon advances in the conveyance direction Y of the belt 24 to pass through the glossing nip Ng with its printed, first surface facing the heater roller 21 and another, opposite surface facing the pressure roller 22. Passage through the glossing nip Ng causes the once-fixed toner image T to soften and re-melt under heat from the heater roller 21 and pressure between the opposed rollers 21 and 22, which allows the sheet S to adhere to the glossing belt 21 due to adhesion of molten toner to the belt surface.

Downstream from the glossing nip Ng, the inner, back side of the glossing belt 24 is cooled by the belt cooler BC from inside the loop of the glossing belt 24, which in turn cools the printed surface of the recording sheet S on the outer, front side of the glossing belt 24. As the recording sheet S cools, the toner image T contacting the belt surface also cools and solidifies to assume a smooth, uniform surface in conformity with the smooth outer surface of the glossing belt 24, resulting in a smooth, glossy effect created on the printed surface of the recording sheet S.

Thereafter, the recording sheet S conveyed on the glossing belt 24 meets the stripper roller 27, at which the curvature of the stripper roller 27 causes the sheet S to separate from the belt surface and finally exit the glossing device 300.

Throughout the glossing process, the surface temperature of the glossing belt 24 as detected by the thermometer 25 is regulated to heat the recording sheet S to a suitable process temperature to obtain a desired gloss on the resulting print. For example, where the belt surface temperature is maintained at approximately 150° C., the recording sheet S is heated to a process temperature ranging from approximately 100° C. to approximately 120° C. during passage through the glossing nip Ng, followed by cooling to a sufficiently low post-process temperature of approximately 40° C. upon separation from the glossing belt 24. In such cases, the resulting image exhibits a gloss, as measured using a 20-degree glossmeter, in a range of approximately 65% to approximately 80%.

With continued reference to FIG. 2, the belt cooler BC is shown including a plurality of individual, separate cooling elements, collectively designated as "40", arranged at different distances from the heater roller 21 inside the loop of the belt 24 to establish thermal contact with the belt 24, and a plurality of heat dissipators, collectively designated as "50", each connected to an associated one of the cooling elements 40, to dissipate heat from the cooling element.

Specifically, in the present embodiment, the belt cooler BC includes a pair of separate, first and second cooling elements 40U and 40D inside the loop of the belt 24, the former being closer than the latter to the heater roller 21 in the conveyance direction Y of the belt 24, and a pair of first and second heat dissipators 50U and 50D connected to the first and second cooling elements 40U and 40D, respectively. Additionally, an intermediate, third cooling element 40I is interposed between the first and second cooling elements 40U and 40D inside the loop of the belt, with a third heat dissipator 50I connected to the cooling element 40I.

Although the belt cooler BC in this embodiment is provided with a single intermediate cooling element 40I in addition to the upstream and downstream cooling elements 40U and 40D, resulting in a total of three separate cooling elements, the total number of cooling elements as well as that of heat dissipators may be other than those depicted herein. For example, the belt cooler BC may be constructed with a total of two to five separate cooling elements with the corresponding number of heat dissipators depending on specific application of the glossing process.

More specifically, in the present embodiment, each of the plurality of cooling elements 40 of the belt cooler BC comprises a liquid-cooled cooling device that employs a liquid coolant to transfer heat from the belt 24.

Figure 3:
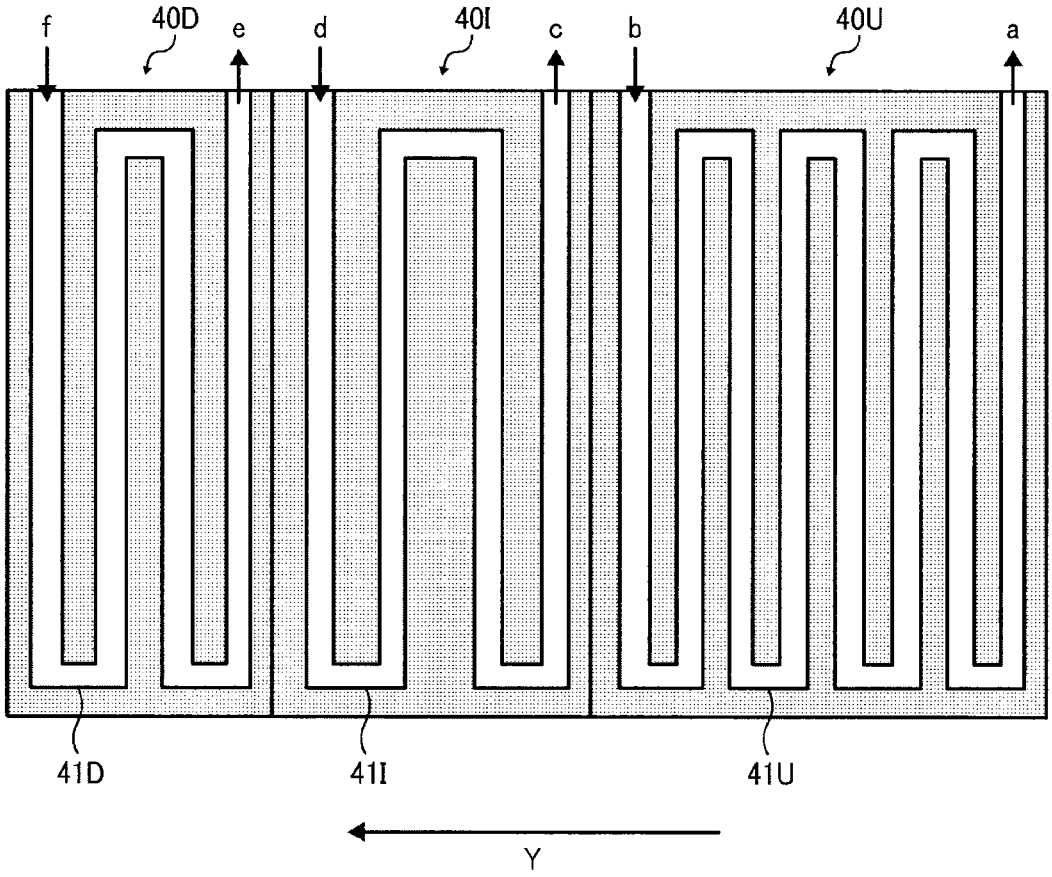
FIG. 3 is a cross-sectional view taken along lines 3-3 of FIG. 2.

With additional reference to FIG. 3, which is a cross-sectional view taken along lines 3-3 of FIG. 2, the cooling elements 40U, 40I, and 40D are shown configured as cold plates of thermally conductive material or metal, such as aluminum, dimensioned with different lengths along the belt 24 and a uniform width across the belt 24. Within each cold plate 40 is defined a serpentine fluid channel 41 having a pair of inlet and outlet openings on opposed ends of the cold plate 40 to allow a liquid coolant to flow from the inlet opening to the outlet opening in alternate, opposing directions perpendicular to the conveyance direction Y of the belt 24, while absorbing heat conducted from the belt 24.

Each of the cold plates 40U, 40I, and 40D is directed with the inlet opening positioned downstream and the outlet opening positioned upstream in the conveyance direction Y of the belt 24, as indicated by alphabetic letters in the drawings: "a" and "b" for the outlet and the inlet, respectively, of the upstream cold plate 40U; "c" and "d" for the outlet and the inlet, respectively, of the intermediate cold plate 40I; and "e" and "f" for the outlet and the inlet, respectively, of the downstream cold plate 40D.

Each of the heat dissipators 50U, 50I, and 50D, associated with the cold plates 40U, 40I, and 40D, respectively, includes a fan-cooled radiator disposed in fluid communication with the channel 41 of the cold plate. The radiator 50 comprises a finned core assembly through which the liquid coolant flows while dissipating heat to the atmosphere, with an inlet thereof connected to the outlet of the cold plate 40 and an outlet thereof connected to the inlet of the cold plate 40. A fan 51 is provided adjacent to the radiator 50 to direct an air flow to the radiator 50 for assisting in efficient transfer of heat. The fan 51 is operable at an adjustable flow rate of, for example, between a minimum level of zero and a maximum level of 11 cubic meters per minute ($m^3/m$).

Between the radiator 50 and the cold plate 40 is a fluid communication path for circulating the liquid coolant, including a pipe or tubing 53 for connecting between the radiator 50 and the cold plate 40; a tank or reservoir 55 for storing the liquid coolant, and a pump 57 connected to the radiator 50 to transfer the liquid coolant from the radiator 50 toward the cold plate 40. The pump 57 can regulate a flow of coolant through the fluid communication path at an adjustable flow rate of, for example, between a minimum level of zero and a maximum level of 15 liters per minute (l/m).

As mentioned above, the plurality of cooling elements 40 are arranged in series between the heater roller 21 and the stripper roller 27 in the conveyance direction Y of the belt 24, so that the first cooling element 40U is closer to the heater roller 21 than the second cooling element 40D, with the third cooling element 40I interposed between the first and second cooling elements 40U and 40D in the conveyance direction Y of the belt 24.

According to this patent specification, the plurality of heat dissipators 50 exhibit different cooling capacities that increase with decreasing distance of the associated cooling elements 40 from the heater roller 21 in the conveyance direction Y of the belt 24.

Specifically, in the present embodiment, the first heat dissipator 50U, connected with the upstream cooling element 40U, exhibits a cooling capacity higher than that of the second heat dissipator 50D, connected with the downstream cooling element 40D. Also, the third heat dissipator 50I, connected with the intermediate cooling element 40I, exhibits a cooling capacity lower than that of the first heat dissipator 50U and higher than that of the second heat dissipator 50D.

As used herein, the term "cooling capacity" refers to an amount of heat removed or dissipated from the cooling element through the heat dissipator per unit of time, the value of which is determined depending on various factors, such as properties of coolant in use and temperatures with which the heat dissipator is operated. For example, where the heat dissipator is constructed of a radiator using a liquid coolant, the cooling capacity of the heat dissipator may be defined by the following equation:

$$Q=\rho CL(T\text{in}-T\text{out}) \qquad \text{Equation 1}$$

where "Q" represents a calculated cooling capacity; "ρ" represents a density of the coolant,; "C" represents a specific heat of the coolant; "L" represents an amount of coolant circulating through the radiator per unit of time; "Tin" is a temperature at the inlet of the radiator; and "Tout" is a temperature at the output of the radiator.

Table 1 below provides an example of calculated cooling capacity of the radiators 50U, 50I, and 50D, respectively, assumed where the fan of each radiator is operated at an air flow speed of 1.8 m/sec.

TABLE 1

| | Radiator | | |
|---|---|---|---|
| | 50U | 50I | 50D |
| Coolant density ρ [kg/m$^3$] | 1018 | 1018 | 1018 |
| Coolant specific heat C [J/(kg * ° C.)] | 3929 | 3929 | 3929 |
| Coolant circulation rate L [l/min] | 4.5 | 4.5 | 4.5 |
| Inlet temperature Tin [° C.] | 70 | 50.5 | 41 |
| Outlet temperature Tout [° C.] | 63.5 | 47.5 | 40 |
| Cooling capacity Q [watt] | 1950 | 900 | 300 |

Further, in addition to be being separated from each other, the plurality of cooling elements 40 of the belt cooler BC may be dimensioned differently with respect to each other, such that an area of thermal contact between the first cooling element 40U and the belt 24 is larger than an area of thermal contact between the second cooling element 40D and the belt 24.

For example, where the plurality of cold plates 40 have a uniform width across the glossing belt 24, an area of thermal contact between the first cooling element 40U and the belt 24 is greater in length in the conveyance direction Y of the belt 24 than an area of thermal contact between the second cooling element 40D and the belt 24, with an area of thermal contact between the intermediate cooling element 40I and the belt 24 smaller in length than that between the first cooling element 40U and the belt 24 and greater in length than that between the second cooling element 40D and the belt 24.

That is, in the conveyance direction Y of the belt 24, the upstream cold plate 40U has a longest length Lu and the downstream cold plate 40D has a shortest length Ld, with the intermediate cold plate 40I having a medium length Li between the longest and shortest lengths Lu and Ld. Specific lengths of the plurality of cold plates 40 may fall within a range of, for example, approximately 150 mm to approximately 400 mm.

In such a configuration, providing the belt cooler BC with the plurality of relatively small, separate independent cooling elements 40, as opposed to a single large integral cooling element, allows for increased efficiency in cooling the glossing belt 24. Separation and independence of the cooling elements 40 from each other results in a relatively large temperature difference between the upstream cooling element 40U and the ambient atmosphere, which allows the heat dissipator 50U connected to the cooling element 40U to more rapidly transfer heat from the liquid coolant to the surrounding air than would be otherwise possible.

In addition, dimensioning the plurality of cooling elements 40 with different areas of contact with the glossing belt 24 allows the upstream cooling element 40U, which is the largest of all the cooling elements 40, to absorb greater amounts of heat from the belt 24 than the other cooling elements, resulting an increased temperature difference between the upstream cooling element 40U and the ambient atmosphere to provide an increased cooling capacity of the heat dissipator 50U connected to the cooling element 40U.

In further embodiment, the cooling capacity of each of the plurality of heat dissipators 50 is adjustable by changing operational parameters of the respective heat dissipators 50. For example, the cooling capacity of the radiator 50 may be adjusted by adjusting a flow rate at which the pump 57 transfers the liquid coolant from the radiator 50 toward the cold plate 40. Alternatively, instead, the cooling capacity of the radiator 50 may be adjusted by adjusting a flow rate at which the fan 51 directs the air flow to the radiator 50.

Such adjustment may be performed to regulate a temperature of the glossing belt 24 at the stripper member 27 not to exceed a maximum allowable temperature of, for example, approximately 40° C., at which toner heated and re-molten through the glossing nip Ng solidifies to produce a highest possible gloss on the resulting print. In such cases, the flow rate of the pump 57 is initially set to a sufficiently low level or to zero, and is subsequently increased to a higher level where the belt temperature rises to a given threshold temperature.

Adjustability of the cooling capacity of each heat dissipator for regulating the belt temperature prevents the belt cooler BC from cooling the belt to an excessively low temperature of, for example, 30° C., which would otherwise require undue amounts of power consumed to cool the glossing belt downstream from the glossing nip and to subsequently re-heat the glossing belt upon entering the glossing nip.

Although in the embodiments described above the belt cooler BC is depicted as including the first and second cooling elements each being a liquid-cooled cooling device, the glossing device 300 according to further embodiments of this patent specification may be configured with different types, numbers, and configurations of cooling elements. One such embodiment is described below with reference to FIG. 4, in which at least one of the first and second cooling elements comprises an air-cooled cooling device.

Figure 4:
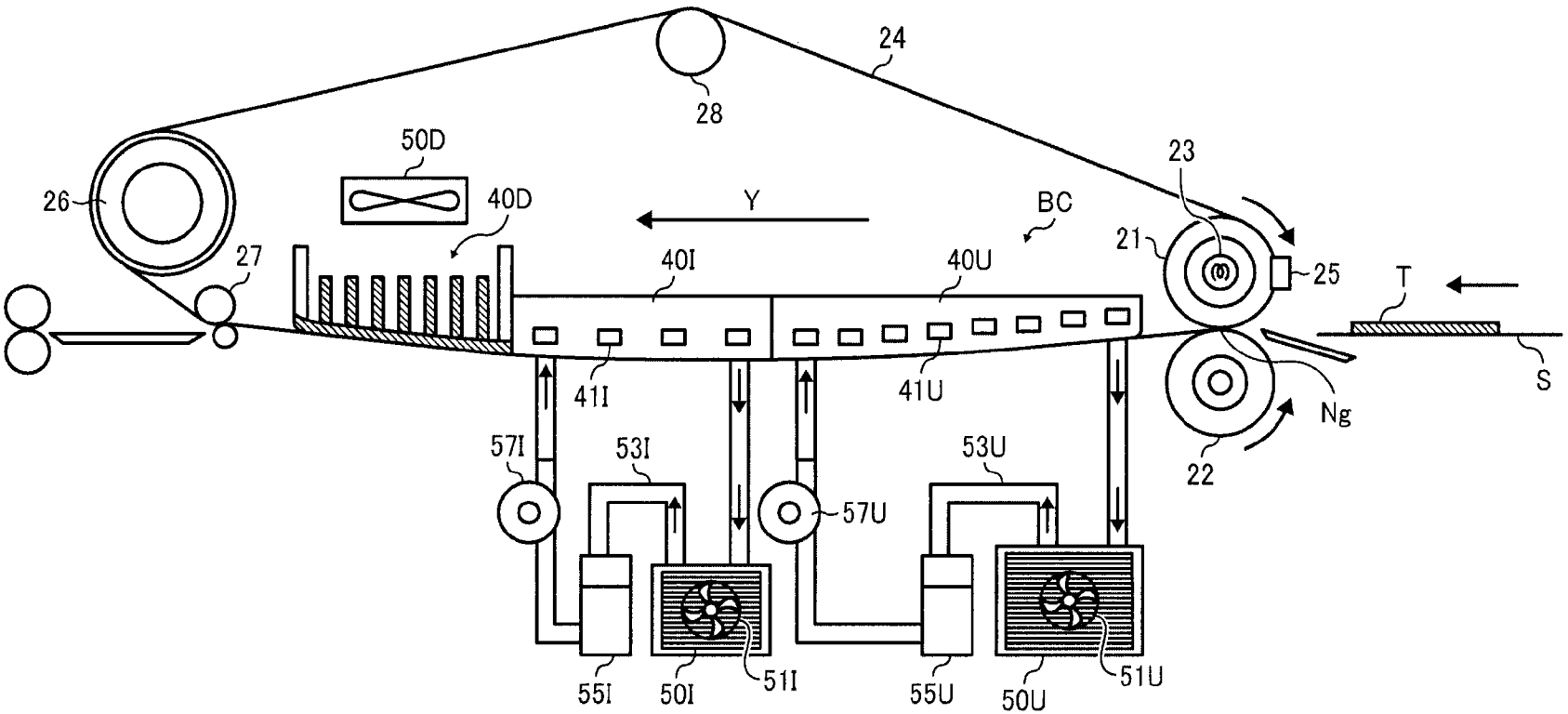
FIG. 4 is an end-on, axial view of the glossing device according to further embodiment of this patent specification.

As shown in FIG. 4, the overall configuration of the glossing device 200 is similar to that depicted primarily with reference to FIG. 2, including the belt cooler BC with the plurality of separate cooling elements 40 and the plurality of heat dissipators 50 associated therewith, except that the downstream, second cooling element 40D comprises an air-cooled cooling device, or heat sink, instead of a liquid-cooled cooling device, and the second heat dissipator 50D comprises a cooling fan that directs an air flow to the heat sink 40D, instead of a radiator.

Compared to a configuration in which all the cooling elements are liquid-cooled cooling devices, which can involve costly and/or complicated pieces of equipment, such as pumps and radiators, using a combination of a liquid-cooled cooling device and an air-cooled cooling device allows for a more simple, inexpensive application of the belt cooler BC according to this patent specification.

Experiments have been conducted to evaluate cooling efficiency of the belt cooler BC included in the glossing device 300 according to this patent specification. In the experiments, two belt-based glossing devices were prepared with different arrangements for cooling the glossing belt: device D1 incorporating the belt cooler BC according to this patent specification, and device D2 incorporating a radiator-based cooling system.

Figure 5:
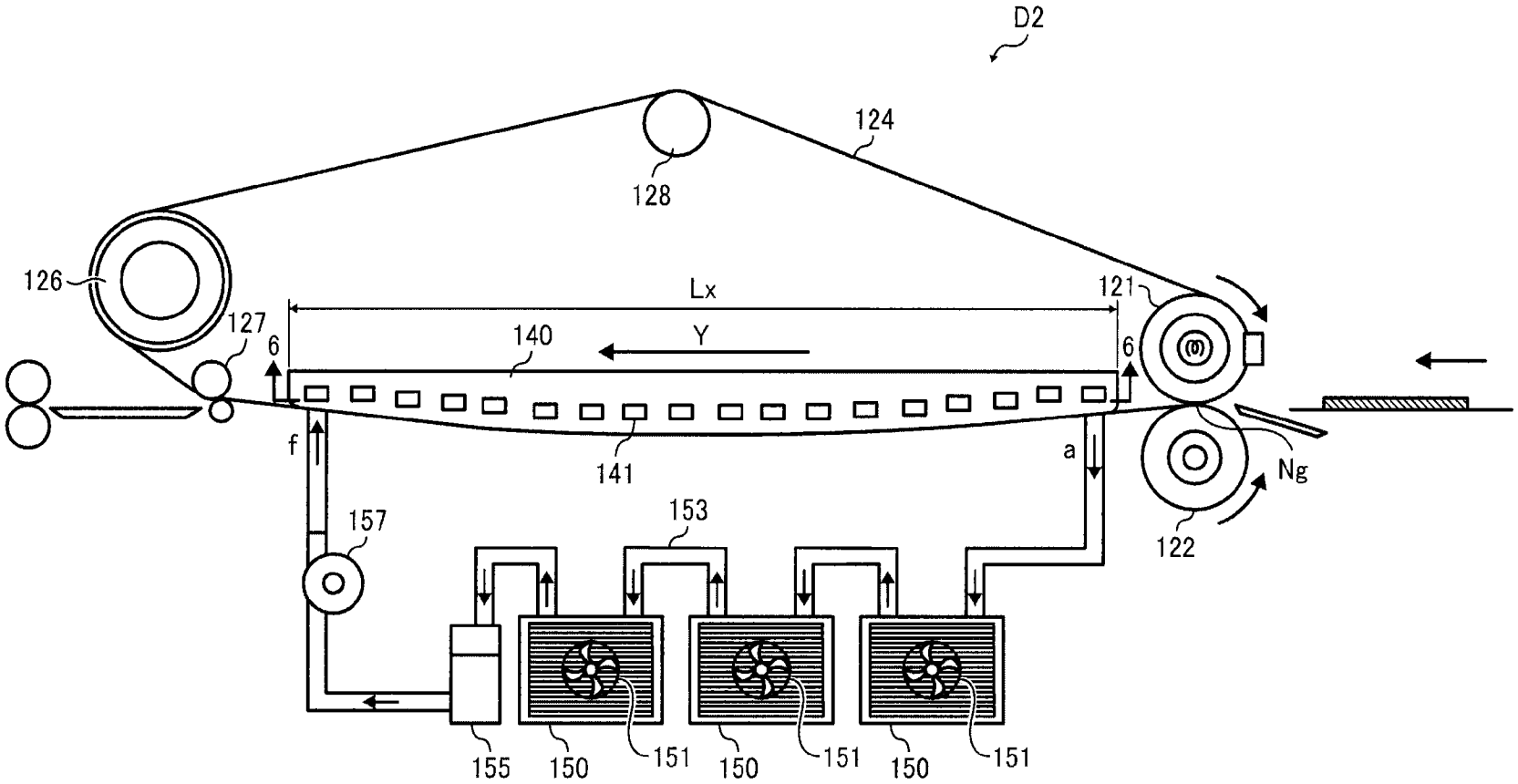
FIG. 5 is an end-on, axial view of a glossing device used in experiments.

FIG. 5 is an end-on, axial view of the glossing device D2 used in the experiments.

As shown in FIG. 5, the overall configuration of the glossing device D2 is similar to that depicted primarily with reference to FIG. 2, including an endless rotary belt 124 looped for rotation around a heater roller 121, a stripper roller 127, and other rollers 126 and 128 in a longitudinal, conveyance direction Y of the belt 124, as well as a pressure roller 122 pressing against the heater roller 121 via the belt 124 to form a glossing nip Ng therebetween, except that the belt cooler includes a single, integral cold plate 140 and multiple fan-cooled radiators 150 connected in series, instead of a plurality of separate cooling elements and a plurality of heat dissipators, each connected to an associated one of the cooling elements.

Figure 6:
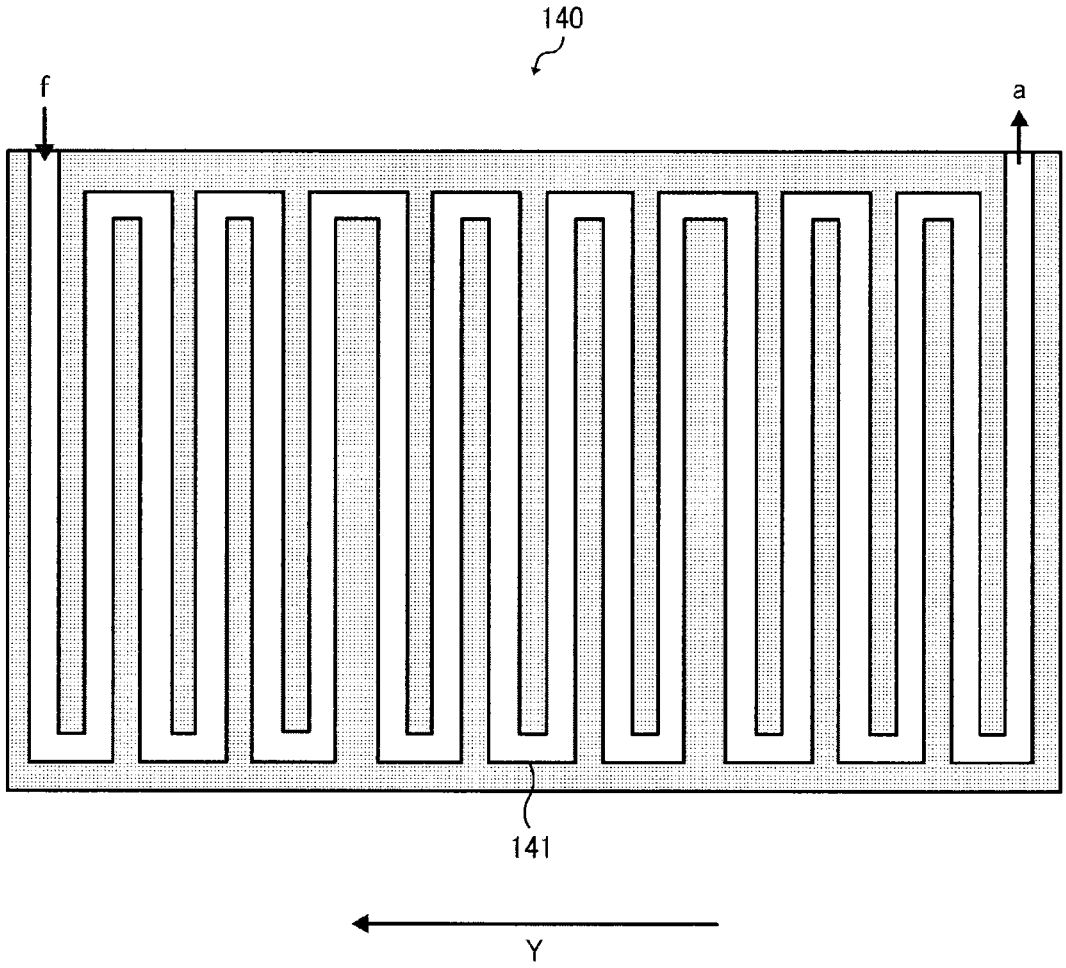
FIG. 6 is a cross-sectional view taken along lines 6-6 of FIG. 5.

With additional reference to FIG. 6, which is a cross-sectional view taken along lines 6-6 of FIG. 5, the cold plate 140 is shown within which is defined a serpentine fluid channel 141 having a pair of inlet and outlet openings on opposed ends of the cold plate. The cold plate 140 is directed with the outlet opening positioned upstream and the inlet opening positioned downstream in the conveyance direction Y of the belt 124, as indicated by "a" and "f", respectively, in the drawing.

The cold plate 140 is dimensioned to have a width similar to that of the plurality of cold plates 40, and a length Lx equal to the total length Lu+Li+Ld of the plurality of cold plates 40 in the conveyance direction Y of the belt.

The radiators 150 are disposed in fluid communication with the cold plate 140, each comprising a finned core assembly equipped with a fan 151. Between the radiators 150 and the cold plate 140 is a fluid communication path for circulating the liquid coolant, including tubing 153 for connecting between the radiators 150 and the cold plate 140; a reservoir 155 for storing the liquid coolant; and a pump 157 for forcing the liquid coolant.

The test devices D1 and D2 were operated continuously for more than an hour at a process speed of 400 mm/sec (comparable to that of a high-speed printer) in an ambient temperature of 30° C. until the cold plates and the liquid coolants were heated to a sufficiently high, saturation temperature. After continuous operation, measurement was carried out to measure temperatures of the liquid coolants at the inlet and outlet openings of the respective cold plates in each of the test devices D1 and D2.

Figure 7:
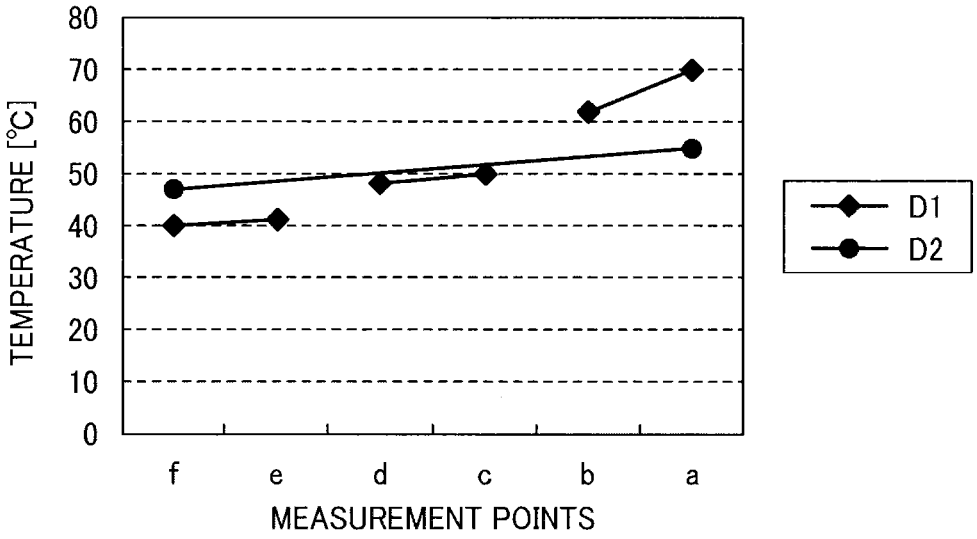
FIG. 7 is a graph showing experimental results.

FIG. 7 is a graph showing results of the measurement, in which square dots represent temperatures obtained at the six measurement points a, b, c, d, e, and f from upstream to downstream in the conveyance direction Y of the belt 24 in the device D1, and round dots represent temperatures obtained at the two measurement points a and f from upstream to downstream in the conveyance direction Y of the belt 124 in the device D2.

As shown in FIG. 7, in general, the temperature of the liquid coolant is higher at the outlet opening than at the inlet opening of the cold plate, as the coolant derives heat from the cold plate during circulation through the fluid channel Specifically, in the device D1, the coolant temperatures at the inlet and outlet openings of the upstream cold plate 40U are 62° C. and 70° C., respectively, yielding a temperature difference of 8° C. therebetween; the coolant temperatures at the inlet and outlet openings of the intermediate cold plate 40I are 48° C. and 50° C., respectively, yielding a temperature difference of 2° C. therebetween; and the coolant temperatures at the inlet and outlet openings of the downstream cold plate 40D are 40° C. and 41° C., respectively, yielding a temperature difference of 1° C. therebetween. In the device D2, the coolant temperatures at the inlet and outlet openings of the integral cold plate 140 are 47° C. and 55° C., respectively, yielding a temperature difference of 8° C. therebetween.

As mentioned earlier, the cooling capacity of the heat dissipator is defined as an amount of heat dissipated from the cooling element through the heat dissipator per unit of time, which is in case of a radiator-based cooling device proportional to a difference between temperatures at the inlet and outlet of the radiator (see Equation I). Since the temperature difference between the inlet and outlet openings of the cold plate, which substantially equals the temperature difference between the inlet and outlet of the radiator, is higher in the upstream cold plate 40U than in the downstream cold plate 50D, the cooling capacity of the radiator 50U connected to the upstream cold plate 40U is higher than that of the radiator 50D connected to the downstream cold plate 40D.

Figure 8:
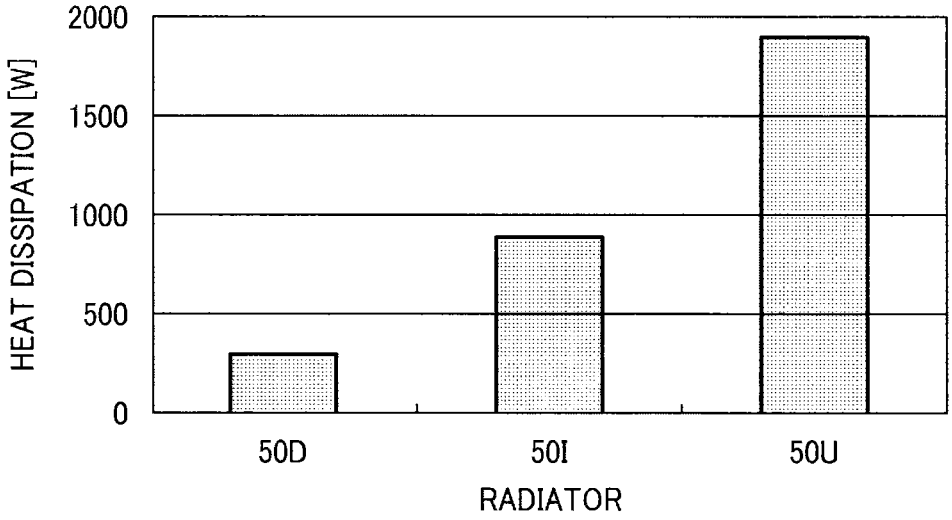
FIG. 8 is a graph showing amounts of heat, in watt (W), dissipated from radiators connected to cold plates in the glossing device.

FIG. 8 is a graph showing amounts of heat, in watt (W), dissipated from the radiators 50U, 50I, and 50D connected to the cold plates 40U, 40I, and 40D, respectively, in the glossing device D1.

As shown in FIG. 8, the amount of heat dissipated by the radiator 50U connected to the upstream cold plate 40U is approximately 2,000 W, whereas the amount of heat dissipated by the radiator 50D connected to the downstream cold plate 40D is approximately 300 W. Such high level of cooling capacity cannot be obtained in the device D2, in which the temperature difference between the cold plate 140 and the ambient atmosphere remains relatively small due to heat conducted throughout the integral cold plate 140 extending across the elongated area along the length of the belt 124, resulting in a relatively low cooling efficiency of the belt cooler compared to that of the device D1 according to this patent specification.

The experimental results demonstrate efficacy of the belt cooler BC included in the glossing device 300 according to this patent specification. That is, providing the belt cooler BC with the plurality of relatively small, separate independent cooling elements 40, as opposed to a single large integral cooling element, allows for increased efficiency in cooling the glossing belt 24. Separation and independence of the cooling elements 40 from each other results in a relatively large temperature difference between the upstream cooling element 40U and the ambient atmosphere, which allows the heat dissipator 50U connected to the cooling element 40U to more rapidly transfer heat from the liquid coolant to the surrounding air than would be otherwise possible.

In addition, dimensioning the plurality of cooling elements 40 with different areas of contact with the glossing belt 24 allows the upstream cooling element 40U, which is the largest of all the cooling elements 40, to absorb greater amounts of heat from the belt 24 than the other cooling elements, resulting an increased temperature difference between the upstream cooling element 40U and the ambient atmosphere to provide an increased cooling capacity of the heat dissipator 50U connected to the cooling element 40U.

Hence, the glossing device 300 according to this patent specification can process a toner image using an endless rotary belt 24 with high-gloss, high-quality imaging performance with increased efficiency in cooling the glossing belt 24, owing to provision of the belt cooler BC with the plurality of relatively small, separate independent cooling elements 40, as opposed to a single large integral cooling element, in combination with the plurality of heat dissipators 50 with different cooling capacities depending on the positions of the cooling elements 40 associated therewith. The image forming apparatus 100 incorporating the fixing device 300 according to one or more embodiments of this patent specification benefits from those and other effects of the fixing device 300.

As used herein, the term "glossing device" herein encompasses any device including a pair of opposed rotary members to process a toner image on a recording medium with heat and pressure, the scope of which is not limited to those designed to gloss an unfixed or pre-fixed toner image with heat and pressure, but also include those designed to simply fix a toner image.

As used herein, the term "glossing device" herein encompasses any device including a pair of opposed rotary members to process a toner image on a recording medium with heat and pressure, the scope of which is not limited to those designed to gloss an unfixed or pre-fixed toner image with heat and pressure, but also include those designed to simply fix a toner image.

Although in several embodiments described herein, the glossing device 300 is shown configured as a self-contained, stand-alone machine exterior to the image forming apparatus 100, the glossing device 300 according to this patent specification may be configured otherwise than as specifically disclosed herein. For example, the glossing device 300 may be provided as an internal component of the image forming apparatus 100, which may be positioned immediately downstream from the fixing device along the sheet conveyance path.

Numerous additional modifications and variations are possible in light of the above teachings. It is therefore to be understood that, within the scope of the appended claims, the disclosure of this patent specification may be practiced otherwise than as specifically described herein.

What is claimed is:

1. A glossing device for processing a toner image on a recording medium, the device comprising:

a heater member subjected to heating;

a stripper member parallel to the heater member;

an endless rotary belt looped for rotation around the heater member and the stripper member in a longitudinal, conveyance direction of the belt;

a pressure member opposite the heater member via the belt;

the heater member and the pressure member pressing against each other via the belt to form a glossing nip therebetween through which the recording medium is conveyed under heat and pressure, the recording medium after passage through the nip remaining in contact with the belt as the belt moves from the heater member toward the stripper member, and separating from the belt as the belt passes around the stripper member; and a belt cooler adjacent to the belt to cool the belt downstream from the heater member and upstream from the stripper member, the belt cooler including:

a pair of cooling elements, including separate first and second cooling elements inside the loop of the belt, the former being closer than the latter to the heater member in the conveyance direction of the belt, to establish thermal contact with the belt; and a pair of heat dissipators, including first and second heat dissipators connected to the first and second cooling elements, respectively, to dissipate heat from the cooling elements, the first heat dissipator exhibiting a cooling capacity higher than that of the second heat dissipator.

2. The glossing device according to claim 1, wherein the belt cooler further includes:

an intermediate, third cooling element interposed between the first and second cooling elements inside the loop of the belt; and a third heat dissipator connected to the third cooling element to dissipate heat from the third cooling element, the third heat dissipator exhibiting a cooling capacity lower than that of the first heat dissipator and higher than that of the second heat dissipator.

3. The glossing device according to claim 1, wherein the belt cooler further includes:

a plurality of intermediate, third cooling elements interposed between the first and second cooling elements and arranged at different distances from the heater member inside the loop of the belt; and a plurality of third heat dissipators, each connected to an associated one of the third cooling elements, to dissipate heat from the third cooling element, the third heat dissipators exhibiting different cooling capacities, lower than that of the first heat dissipator and higher than that of the second heat dissipator, which increase with decreasing distance of the associated cooling elements from the heater member in the conveyance direction of the belt.

4. The glossing device according to claim 1, wherein an area of thermal contact between the first cooling element and the belt is larger than an area of thermal contact between the second cooling element and the belt.

5. The glossing device according to claim 1, wherein an area of thermal contact between the first cooling element and the belt is greater at least in length in the conveyance direction of the belt than an area of thermal contact between the second cooling element and the belt.

6. The glossing device according to claim 1, wherein at least one of the first and second cooling elements comprises a liquid-cooled cooling device.

7. The glossing device according to claim 1, wherein at least one of the first and second cooling elements comprises an air-cooled cooling device.

8. The glossing device according to claim 1, wherein the first cooling element comprises a liquid-cooled cooling device and the second cooling element comprises an air-cooled cooling device.

9. The glossing device according to claim 1, wherein at least one of the first and second cooling elements includes:

a cold plate of thermally conductive material within which a fluid channel is defined to allow a liquid coolant to circulate therethrough while absorbing heat conducted from the belt, each heat dissipator associated with said at least one of the first and second cooling elements includes:

a radiator in fluid communication with the fluid channel of the cold plate;

a fan adjacent to the radiator to direct an air flow to the radiator; and a pump connected to the radiator to transfer the liquid coolant from the radiator toward the cold plate.

10. The glossing device according to claim 9, wherein cooling capacity of the radiator is adjustable by adjusting a flow rate at which the pump transfers the liquid coolant from the radiator toward the cold plate.

11. The glossing device according to claim 9, wherein cooling capacity of the radiator is adjustable by adjusting a flow rate at which the fan directs the air flow to the radiator.

12. The glossing device according to claim 9, wherein cooling capacity of the radiator is adjusted to regulate a temperature of the belt at the stripper member not to exceed approximately 40 degrees Celsius.

13. The glossing device according to claim 1, wherein at least one of the first and second cooling elements includes a heat sink, each heat dissipator associated with said at least one of the first and second cooling elements includes a fan to direct an air flow toward the heat sink.

14. A glossing device for processing a toner image on a recording medium, the device comprising:

a heater member subjected to heating;

a stripper member parallel to the heater member;

an endless rotary belt looped for rotation around the heater member and the stripper member in a longitudinal, conveyance direction of the belt;

a pressure member opposite the heater member via the belt;

the heater member and the pressure member pressing against each other via the belt to form a glossing nip therebetween through which the recording medium is conveyed under heat and pressure, the recording medium after passage through the glossing nip remaining in contact with the belt as the belt moves from the heater member toward the stripper member, and separating from the belt as the belt passes around the stripper member; and a belt cooler adjacent to the belt to cool the belt downstream from the heater member and upstream from the stripper member, the belt cooler including:

a plurality of separate cooling elements arranged at different distances from the heater member inside the loop of the belt to establish thermal contact with the belt; and a plurality of heat dissipators, each connected to an associated one of the cooling elements, to dissipate heat from the cooling element, the plurality of heat dissipators exhibiting different cooling capacities that increase with decreasing distance of the associated cooling elements from the heater member in the conveyance direction of the belt.

15. An image forming apparatus comprising:

means for forming a toner image on a recording medium; and a glossing device to process the toner image with heat and pressure on the recording medium, the device comprising:

a heater member subjected to heating;

a stripper member parallel to the heater member;

an endless rotary belt looped for rotation around the heater member and the stripper member in a longitudinal, conveyance direction of the belt;

a pressure member opposite the heater member via the belt;

the heater member and the pressure member pressing against each other via the belt to form a glossing nip therebetween through which the recording medium is conveyed under heat and pressure, the recording medium after passage through the nip remaining in contact with the belt as the belt moves from the heater member toward the stripper member, and separating from the belt as the belt passes around the stripper member; and a belt cooler adjacent to the belt to cool the belt downstream from the heater member and upstream from the stripper member, the belt cooler including:

a pair of cooling elements, including separate first and second cooling elements inside the loop of the belt, the former being closer than the latter to the heater member in the conveyance direction of the belt, to establish thermal contact with the belt; and a pair of heat dissipators, including first and second heat dissipators connected to the first and second cooling elements, respectively, to dissipate heat from the cooling elements, the first heat dissipator exhibiting a cooling capacity higher than that of the second heat dissipator.

* * * * *